US008418808B2

(12) United States Patent
Merritt

(10) Patent No.: US 8,418,808 B2
(45) Date of Patent: Apr. 16, 2013

(54) CLIMBING AID

(76) Inventor: Rodney Merritt, East Machias, ME (US)

( * ) Notice: Subject to any disclaimer, the term of this patent is extended or adjusted under 35 U.S.C. 154(b) by 653 days.

(21) Appl. No.: 12/343,640

(22) Filed: Dec. 24, 2008

(65) Prior Publication Data

US 2010/0155178 A1 Jun. 24, 2010

(51) Int. Cl.
*E04G 13/02* (2006.01)

(52) U.S. Cl.
USPC ..... 182/92; 248/218.4

(58) Field of Classification Search ..... 182/92; 248/219.4, 218.4
See application file for complete search history.

(56) References Cited

U.S. PATENT DOCUMENTS 1,103,719 A * 7/1914 Wheeler ..... 182/90
1,322,869 A * 11/1919 Benedict ..... 182/92
2,097,562 A * 11/1937 Day ..... 182/189
2,238,134 A * 4/1941 Schoen ..... 248/541
2,392,538 A 5/1945 Knudsen
3,149,696 A * 9/1964 Anderson ..... 182/92
3,462,110 A * 8/1969 Cheslock ..... 248/219.4
3,598,201 A 8/1971 Thurmond
3,835,958 A * 9/1974 Hegele ..... 182/92
3,930,562 A * 1/1976 Zorn ..... 182/92
3,949,835 A * 4/1976 Butler ..... 182/187
4,027,742 A * 6/1977 House, Jr. ..... 182/92
4,049,225 A * 9/1977 Chasen et al. ..... 248/219.4
4,109,761 A 8/1978 Matlock
4,382,416 A * 5/1983 Kellogg-Smith ..... 114/90
4,422,527 A * 12/1983 Schultz et al. ..... 182/92
4,449,612 A 5/1984 Southard
4,618,028 A 10/1986 Dale
4,620,610 A * 11/1986 Southard ..... 182/92
4,674,597 A * 6/1987 Humphrey ..... 182/92
4,700,807 A * 10/1987 Kubiak ..... 182/92
4,775,030 A * 10/1988 Wright ..... 182/92
4,867,272 A * 9/1989 Troubridge ..... 182/92
4,896,454 A * 1/1990 Cronenwett et al. ..... 47/57.5
5,279,388 A * 1/1994 Laughlin et al. ..... 182/92
5,310,151 A * 5/1994 Engel ..... 248/230.8
5,417,306 A 5/1995 Robl
5,470,054 A * 11/1995 Bohrman ..... 473/481
5,598,995 A * 2/1997 Meuth et al. ..... 248/74.3
5,601,263 A * 2/1997 Thayer ..... 248/75
5,626,318 A * 5/1997 Boettger et al. ..... 248/205.2
5,685,103 A * 11/1997 Wiggins ..... 42/94
5,755,178 A * 5/1998 Lush ..... 119/51.03
5,769,372 A * 6/1998 Klosterman ..... 248/219.4
5,785,447 A * 7/1998 Fonti et al. ..... 403/49
5,810,113 A * 9/1998 Jones ..... 182/92
5,881,837 A * 3/1999 Leicht ..... 182/92

(Continued)

*Primary Examiner* — Katherine Mitchell
*Assistant Examiner* — Daniel Cahn
(74) *Attorney, Agent, or Firm* — Pierce Atwood LLP; Kevin M. Farrell

(57) ABSTRACT

The present invention is directed to a non-destructive, ergonomic climbing aid for use in climbing a columnar structure. The climbing aid comprises a body portion and a tensioning member for affixing the body to the columnar structure. The body comprises a contact surface, a support surface and a projecting portion joining between the contact surface and the support surface. In use, the contact surface has a substantially vertical axis and contacts the columnar structure. In use, the support surface supports a foot or hand and the projecting portion is cantilevered so that the support surface has no direct contact with the columnar structure. The support surface has a substantially perpendicular orientation relative to the substantially vertical axis of the contact surface.

10 Claims, 5 Drawing Sheets

U.S. PATENT DOCUMENTS

| | | | | |
|---|---|---|---|---|
| 5,941,485 | A * | 8/1999 | Davidson et al. | 248/218.4 |
| 5,944,139 | A * | 8/1999 | Kozial | 182/92 |
| 5,967,475 | A * | 10/1999 | Johnson | 248/217.4 |
| D420,147 | S * | 2/2000 | Woller et al. | D25/64 |
| 6,202,964 | B1 * | 3/2001 | Thornhill | 248/219.4 |
| 6,431,315 | B1 * | 8/2002 | Lewis | 182/92 |
| 6,439,343 | B1 * | 8/2002 | Jorges et al. | 182/92 |
| 6,478,272 | B1 * | 11/2002 | McKinsey et al. | 248/216.1 |
| 6,491,272 | B1 * | 12/2002 | Franks | 248/218.4 |
| 6,508,446 | B1 * | 1/2003 | Addison et al. | 248/218.4 |
| 6,726,162 | B1 * | 4/2004 | Winter | 248/218.4 |
| 7,134,524 | B2 * | 11/2006 | Sprague | 182/92 |
| 7,156,206 | B2 | 1/2007 | Prejean | |
| D590,068 | S * | 4/2009 | Woller | D25/62 |
| 7,690,481 | B1 * | 4/2010 | Pederson | 182/133 |
| 2002/0121406 | A1 * | 9/2002 | Summers | 182/92 |
| 2004/0216952 | A1 * | 11/2004 | Woller | 182/93 |

* cited by examiner

CLIMBING AID

BACKGROUND

1. Field of the Invention

The present invention relates generally to climbing devices and more particularly to a non-destructive, ergonomic climbing aid for use in climbing a columnar structure.

2. Discussion of Background Information

Ascending certain columnar structures requires deployment of extraneous climbing devices. For example large trees, utility poles, bridge supports and ski lift poles are tall columnar structures having no hand or foot holds for safe ascension and descent. Hunters often ascend trees and perch in upper branches in wait of prey. These trees often lack low-lying, climbable branches, and hunters therefore deploy portable climbing devices to ascend the trunks. These portable climbing devices range from horizontal posts that pierce the cambium layer of a tree, to metal steps that affix to a tree with an encircling strap or tensioned chain.

Post type devices permanently damage living trees, and this deleterious act is often illegal in publicly protected wooded areas. A typical tree climbing step comprises a pyramidal or conical body formed of sheet metal having a support surface that interfaces directly with a tree to provide a small platform for supporting the ball of a foot. When weighted, the typical step slides down the tree trunk, scraping away layers of bark and potentially piercing the cambium layer, until a strap or cord retaining the step stretches fully and provides sufficient tension force to halt movement of the step. This sliding and scraping not only damages the tree, but potentially causes a climber to lose his balance during ascension and descent.

Additionally, these steps fail to provide any ergonomic advantage to a climber because they directly abut the tree and provide little room for sturdy foot placement at a natural stepping angle. This alignment requires a user to wedge his foot directly against the tree so that the instep rests against the tree and only a small, outside edge of the foot rests on the step, potentially causing a misstep or loss of balance and a catastrophic fall. Furthermore, these step devices often provide only a stepping surface and offer no secure, comfortable handholds for the climber to grasp during ascension and descent.

Additionally, existing metal steps would be unsuitable for climbing smooth columnar structures having no bark and little to no surface topography. For example, utility technicians and civil engineers often must climb utility poles or bridge supports for maintenance and inspection. Existing climbing devices would slide down a sheer columnar structure significantly because of a lack of friction. Furthermore, certain columnar structures, such as bridge support I-beams, present a perfectly planar face, further increasing likelihood of slippage because typical climbing aids comprise curved contact surfaces for interfacing with curved columns. Adapting current tree climbing devices for use with columnar structures having planar surfaces would require at least the inclusion of sufficiently large tension straps to provide enough retention force to establish a sufficient factor of safety during use and would require at most a complete re-facing to match the contour of a planar surface.

A need therefore exists for a portable and ergonomic device for safely and comfortably climbing and descending a columnar structure without inflicting damage.

SUMMARY OF THE INVENTION

The present invention solves the problems associated with existing climbing aids for climbing columnar structures and provides a reliable, light weight, safe, portable, ergonomic climbing aid that inflicts no permanent damage on living structures.

The present invention is directed to a portable climbing aid for use in climbing a columnar structure. One embodiment of the climbing aid comprises a body and a tension member for affixing the body to the columnar structure. The body comprises a contact surface, a support surface and a projecting portion joining between the contact surface and the support surface. In use, the contact surface has a substantially vertical axis and contacts the columnar structure. In use, the support surface supports a foot or hand and the projecting portion is cantilevered so that the support surface has no direct contact with the columnar structure. The support surface has a substantially perpendicular orientation relative to the substantially vertical axis of the contact surface.

BRIEF DESCRIPTION OF THE DRAWINGS

One will better understand these and other features, aspects, and advantages of the present invention following a review of the description, appended claims, and accompanying drawings in which:

DETAILED DESCRIPTION

The present invention solves the problems associated with existing climbing aids for climbing columnar structures and provides a reliable, light weight, safe, portable, ergonomic climbing aid that inflicts no permanent damage on underlying structures.

Figure 1:
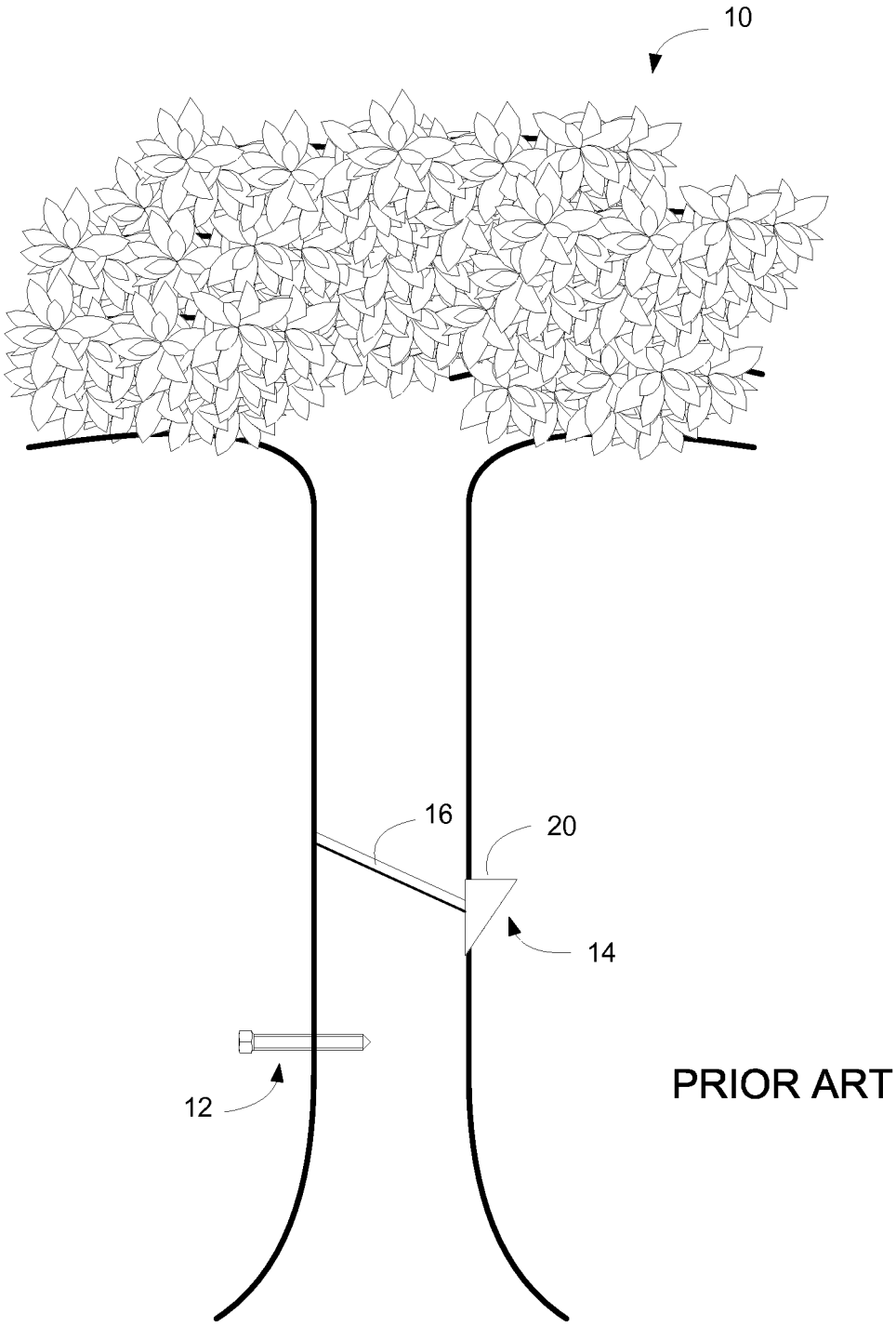
FIG. 1 shows prior art devices.

As FIG. 1 depicts, prior art devices offer little or no support for a hand or foot and often inflict permanent damage on a columnar structure, such as a living tree 10. Post-style climbing aids 12 pierce the through the bark of a tree and puncture the cambium layer, the formative layer of a tree that generates new cells. Puncturing this layer prevents cell generation and leaves the tree open to the elements and at high risk for rot. Step-style climbing aids 14, such as those which hang from a tensioned strap 16 that encircles the tree 10, present shortcomings as well. The climbing surface 20 of the step-style climbing aid 14 provides little surface area for securely supporting a hand or foot. Furthermore, the step-style climbing aid 14 abuts the tree 10 such that a foot will overhang or potentially land at an angle, with the instep wedged up against the tree 10, rolling the ankle outward. This positioning could cause injury to the ankle or lead a climber to lose his balance and fall. Furthermore, neither the post-style climbing aid 12 nor the step-style climbing aid 14 provides ergonomic handholds, let alone any sufficient handholds, for a climber to grasp securely during ascension and descent.

Figure 2:
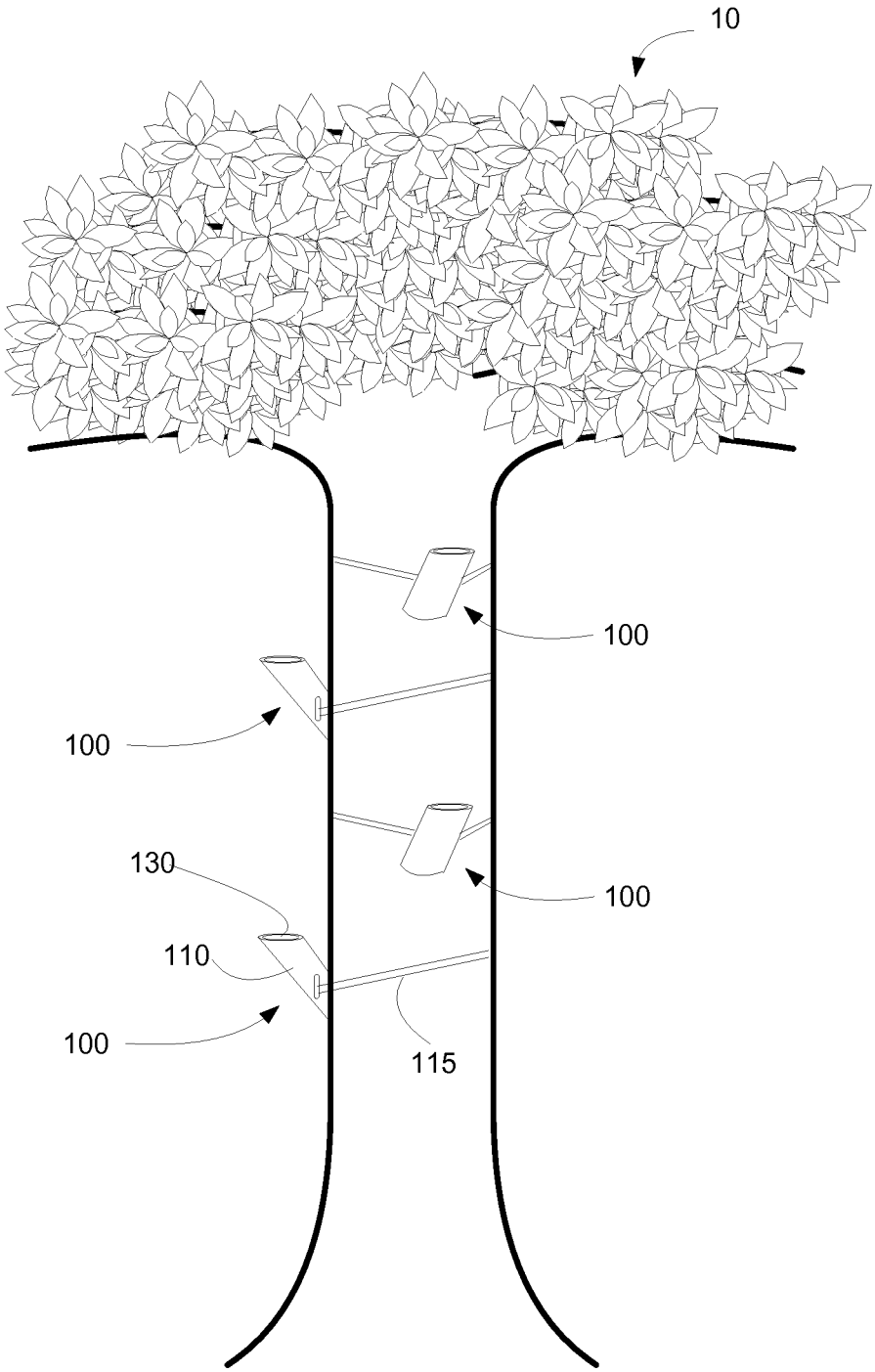
FIG. 2 shows a side perspective view of a plurality of devices according to one embodiment of the present invention deployed for use.

Turning now to FIGS. 2 through 6, one embodiment of the climbing aid 100 of the present invention as shown solves these deficiencies of the prior art devices. FIG. 2 depicts a plurality of climbing aids 100 deployed for use in ascending and descending a tree 10 comfortably and safely while causing no harm to a user or the living tree 10. The climbing aid 100 comprises a body 110 and a tension member 115 adapted for affixing the body to a columnar structure, such as the tree 10 depicted in FIG. 2.

Figures 3A, 3B, 3C:
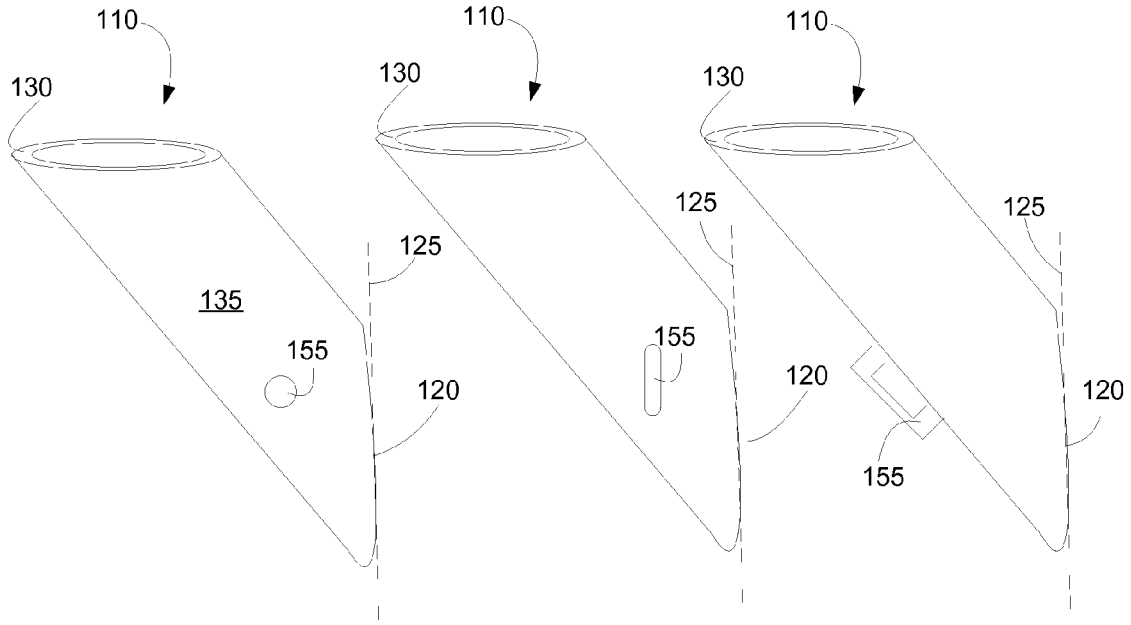
FIG. 3*a* shows a side perspective view of one embodiment of the present invention.
FIG. 3*b* shows a side perspective view of one embodiment of the present invention.
FIG. 3*c* shows a side perspective view of one embodiment of the present invention.
Figure 4:
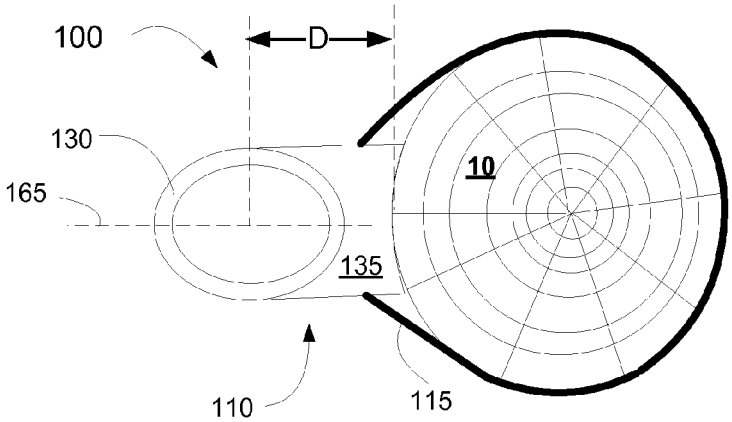
FIG. 4 shows a top view of one embodiment of the present invention.

The body 110 comprises a contact surface 120 that, in use, contacts the columnar structure and has a substantially vertical axis 125, indicated in FIGS. 3A through 3C by a dashed line. The body 110 further comprises a support surface 130 for supporting a foot or a hand when in use, the support surface 130 having no direct contact with the columnar structure and having a substantially perpendicular orientation relative to the substantially vertical axis 125 of the contact surface 120. The body 110 further comprises a projecting portion 135 extending between the contact surface 120 and the support surface 125. The projecting portion 135 is cantilevered when the climbing aid 100 is in use, and this cantilevered orientation spaces the support surface 130 apart from the columnar structure. For example, FIG. 4 depicts a top view of one embodiment of the climbing aid 100 affixed to a tree 10 by the tension member 115 such that the contact surface 120 firmly abuts the tree and the support surface 130 is cantilevered upward and outward from the tree 10 at a distance D.

In one embodiment, the contact surface 120 is concave for accommodating the curvatures of the columnar structure, here a tree 10 having a substantially round cross section. In other embodiments, the contact surface 120 may be planar for fully abutting a planar columnar structure, such as a bridge support I-Beam. In still yet other embodiments, the contact surface 120 may comprise a layer of compressible, malleable material disposed thereon for conforming to and accommodating irregularities or surface contours of the columnar structure and providing a secure seal between the contact surface 120 and the columnar structure. For example, as FIG. 5A indicates, the climbing aid 100 may comprise a malleable sleeve 140 attached to and/or covering the contact surface 120 for filling in and around the raised and depressed topography of the bark of a tree 10 when the body 110 is tensioned against the tree 10 by the tensioning member 115. This embodiment of the climbing aid 100 forms a secured compression fit when tensioned against a columnar structure having surface irregularities, thereby evenly distributing forces throughout the entire contact surface 120. This increased contact also increases the vertical friction force F(mu), indicated in FIG. 6, existing between the contact surface 120 and the columnar structure, here a tree 10. This increased contact and increased friction force F(mu) further reduces the likelihood of slippage or wobble when a user applies force F(user) to the support surface 130. Such a sleeve 140 may be elasticized and adhere to the projecting portion 135 of the body 110 through inward radial forces and/or the sleeve 140 may attach to the body 110 via adhesive disposed between the body 110 and the sleeve 140. Alternatively, the sleeve 140 may be a gasket applied directly to the contact surface 120 via an adhesive means. The compressible material comprising the sleeve 140 may be any sturdy fabric or compound capable of withstanding the elements and may be, for example, foam, neoprene or rubber.

Figure 5A:
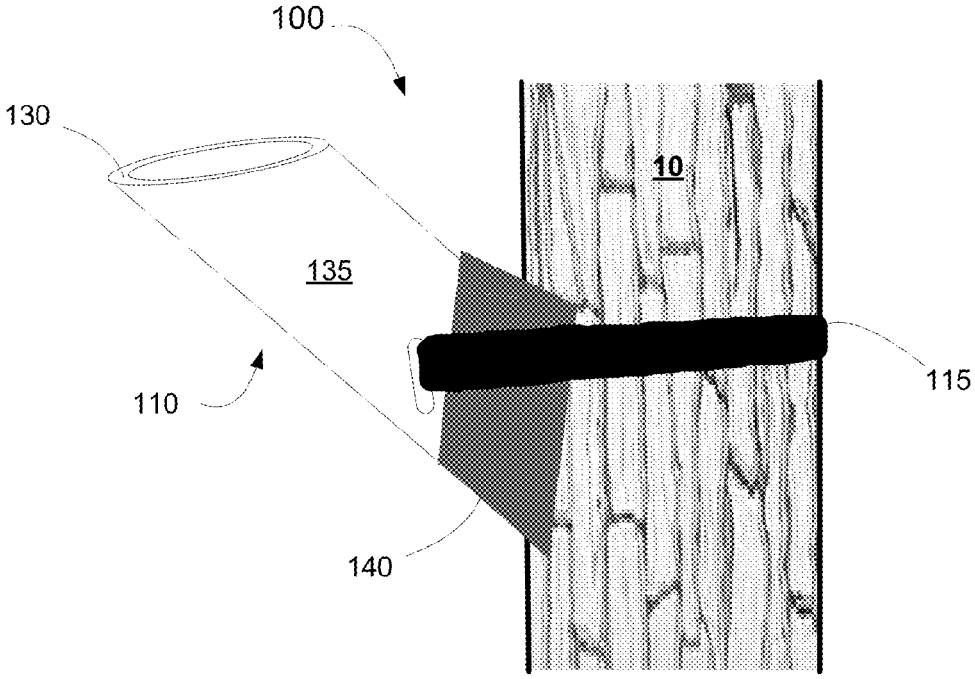
FIG. 5*a* depicts a side-perspective view of one embodiment of the present invention.
Figure 5B:
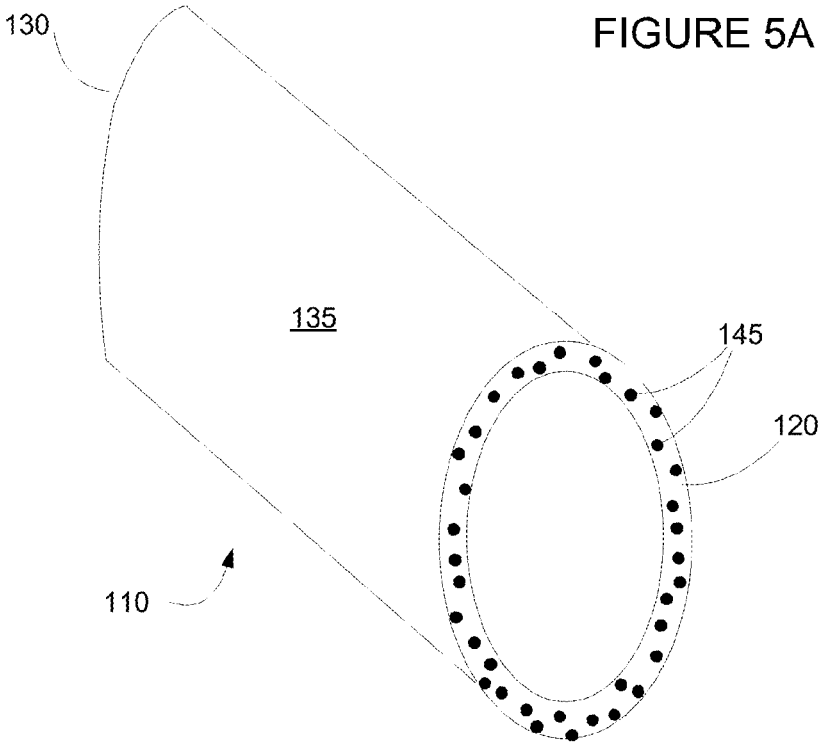
FIG. 5B depicts an end-perspective view of one embodiment of the present invention.

Embodiments of the climbing aid 100 comprising a gasket or sleeve 140 present a higher coefficient of friction at the contact surface 120, resulting in a larger friction force F(mu) in use because the malleable material is less likely to slip against a columnar structure than a smooth, uncovered contact surface 120. Other embodiments of the climbing aid 100 may comprise a particulate matter 145 disposed on the contact surface 120, as shown in FIG. 5B. This particulate matter 145 may be any composition that decreases smoothness of the contact surface 120 and increases resistance to slippage during use, again increasing the friction force F(mu) between the contact surface 120 and the columnar structure. Such particulate matter 140 may be any material such as but not limited to sand, powder, and metal dust or shavings, adhered to the contact surface through any sturdy adhesive means, such as epoxy. In yet another embodiment, the climbing aid 100 may comprise an abraded contact surface 140 also contributing to an increased friction force F(mu). Embodiments of the climbing aid 100 comprising particulate matter 145 on the contact surface 120 and embodiments comprising an abraded contact surface 120 are particularly well suited for use with smooth columnar structures, such as utility poles and structural I-beams, offering no surface topography for contributing to the friction force F(mu).

Turning back to FIGS. 3A through 4, one embodiment of the climbing aid 100 comprises a tubular body 110. Although other cross-sectional geometries are suitable, for example square or triangular, a tubular body 110 ensures even distribution of forces and no points of weakness at sharp corner bends. The body 110 may be manufactured from any lightweight, sturdy material capable of withstanding high compression and shear forces while providing a sufficient factor of safety for protecting a user. For example, the body may be a hollow tube manufactured from a material selected from a group consisting of Polyvinyl chloride (PVC) tubing, extruded and/or tempered steel, chromoly, fiberglass and cast aluminum. Preferably, the material is lightweight but durable enough to withstand extreme weather conditions, such as heat, cold, rain, sleet, snow and ice, without corroding or otherwise cracking and weakening. In one embodiment, for example, the body 110 is formed of ASTM Schedule 40 or ASTM Schedule 80 PVC pipe and has a wall thickness of at least 200 mils. This configuration provides sufficient surface area on the contact surface 130 for supporting a hand or a foot and provides enough strength to withstand compression and shear forces during use. Such PVC pipe is sufficiently durable to withstand extreme weather conditions and changing weather conditions without expanding, contracting or cracking. Furthermore, PVC is resistant to corrosion and may be painted any number of colors to blend with surroundings.

Figure 6:
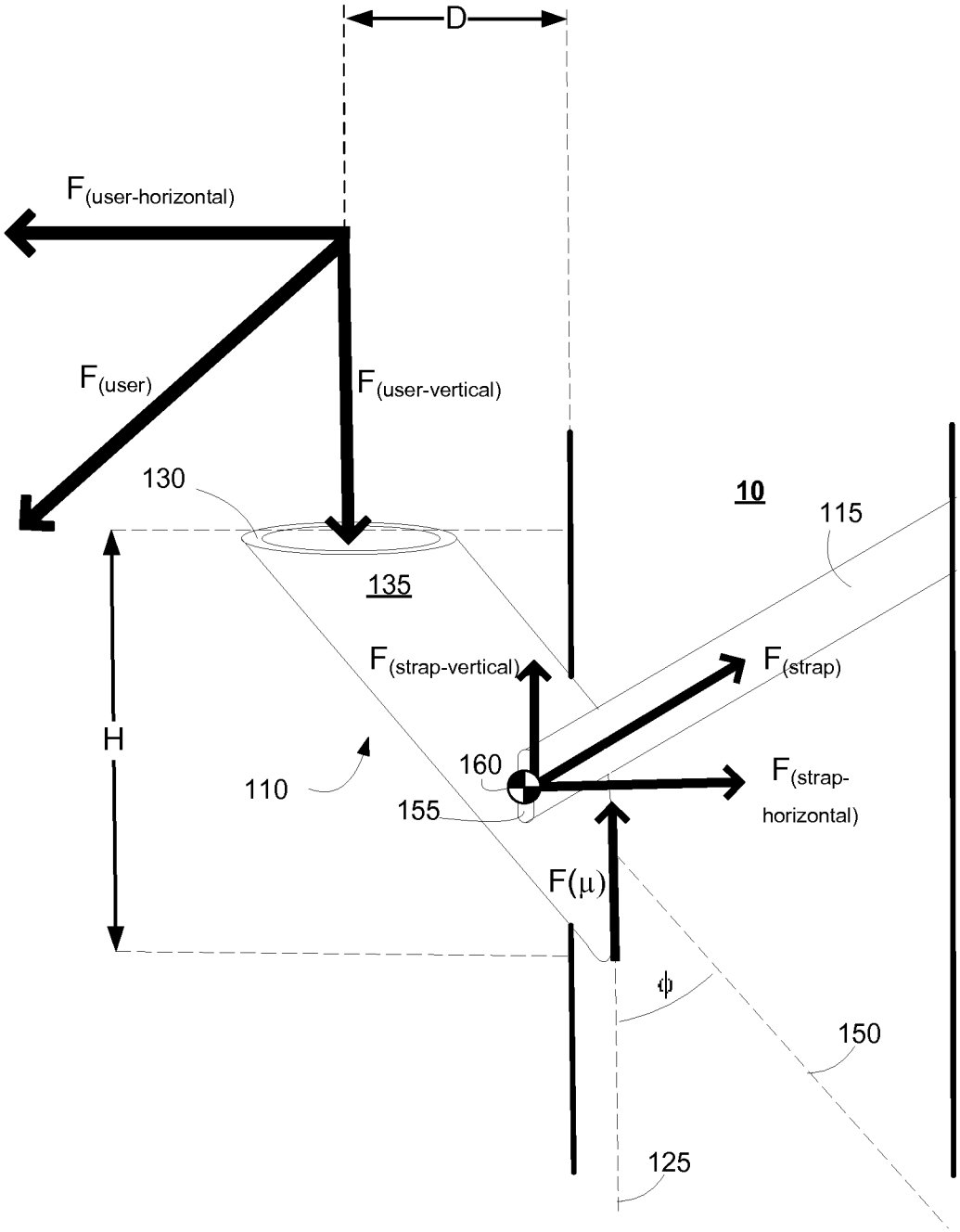
FIG. 6 depicts a force diagram for one embodiment of the present invention during use.

Manufacturing the climbing aid 100 from a Schedule 40 or Schedule 80 pipe having a circular cross section also ensures a sufficient factor of safety in overcoming compression and shear forces. FIG. 6 depicts a simple force diagram demonstrating the critical forces applied to the climbing aid 100 during use. Here, the contact surface 120 abuts a columnar structure, a tree 10 for example, and the projecting portion 135 of the body 110 extends upward and outward so that a central axis 150 of the projecting portion 135 forms an angle $\phi$ between 0 and 90 degrees, and more preferably between 35 and 55 degrees, from the vertical axis 125 of the contact surface 120. The projecting portion 135 may have a length measuring between 6 to 12 inches such that a distance D between the support surface 130 and the tree 10 is large enough to comfortably accommodate a hand or a foot without the hand or foot impacting the tree 10 and thereby causing a climber to lose his balance.

Because the projecting portion 135 is cantilevered in use, application of a downward force F(user-vertical) upon the support surface 130 creates a moment arm equal to the downward force F(user-vertical) times the distance D. If a user grasps the support surface 130 with a hand and suspends from the body 110, the force of the user F(user) creates yet another moment arm equal to a horizontal force F(user-horizontal) times a height H spanned by the projecting portion 135. The longer the projecting portion 135, the greater the distance D and height H and the greater the resulting moment arms. Selecting the length of the projecting portion 135 requires consideration at least of cross-sectional measurements of the body 110, the particular angle ϕ of projection, and a desired factor of safety.

Care must be applied in calculating and balancing competing forces so as to provide a user with a sufficient factor of safety. Forces applied to the climbing aid 100 include the force of the user F(user) having at least a vertical component F(user-vertical) and potentially a horizontal component F(user-horizontal). These forces create moment arms that induce shear stresses upon the body 110. In addition to the friction force F(mu) existing between the contact surface 120 and the columnar structure, here a tree 10, the tensioning member 115 also supplies an opposing force. Here, in FIG. 6, the tensioning member 115 is a strap which, under tension, applies upon the body 110 a strap force F(strap) having a strap-vertical force component F(strap-vertical) and strap horizontal force component F(strap-horizontal).

The tensioning member 115 inserts through a retaining element 155 in or on the body 110 and wraps around the columnar structure. As FIGS. 3A through 3C depict, the retaining element 155 may have any number of geometries. For example, the retaining element 155 may be a plurality of diametrically opposed circular holes, a plurality of diametrically opposed elongated slots or a hook or closed loop projecting outward from an outer surface of the body 110 so that a tensioning member 115 may encircle the body 110 and pass through the retaining element 155. The retaining element 155 may be sized and shaped to receive a particular geometry of a tensioning member 115, such as, for example, a substantially round rope, a substantially flat nylon strap, or a chain. Once tensioned around the columnar structure and through or around the body 110, the tensioning member 115 is secured, for example, by knotting, buckling, or a ratcheting the free ends. Placement of the retaining element 115 along the body 110 contributes to the magnitude and orientation of force applied by the tensioning member 115, here strap force F(strap). For example, in one embodiment of the climbing aid, the length-wise dimension of an elongated slot style retaining element 155 is parallel to the contact surface 120, and the slot is formed anywhere along the projecting portion 135 of the body 110 between support surface 130 and the contact surface 120, but preferably at a center of gravity 160. Furthermore, in one embodiment, the retaining element 155 is oriented substantially normal to the contact surface 120 so that a tensioning member 115 may encircle the columnar structure and pass through the retaining element 155 while securely pressing the contact surface against the columnar structure. Because of these well-balanced tension and compression forces, the climbing aid 100 prevents slippage and avoids scraping and potentially damaging the underlying columnar structure, such as a tree 10.

Once tensioned securely against a columnar structure by a tensioning member 115, the body 110 of the climbing aid 100 assumes a cantilevered position wherein the support surface 130 suspends above the ground at a distance D from the columnar structure. In an embodiment having a tubular projecting portion 135, the support surface 130 has an elliptical shape, as depicted clearly in FIG. 4. In one embodiment, the contact surface 130 may comprise a solid surface or end cap applied to the projecting portion 135, and in yet another embodiment the projecting portion near the contact surface 130 may comprise contoured hand holds or cut outs through which fingers may curve for an ergonomic overhand grasp of the contact surface 130 of a tubular body 110.

In another embodiment having a tubular body 110, the major axis 165 of the contact surface 130 has a length, for example, of 4 to 5 inches so as to support a hand or a foot landing in any orientation. A user, therefore, need not perfectly place each of the plurality of climbing aids 100 as indicated in FIG. 2. Because the contact surface 130 is cantilevered out away from the columnar structure and because the support surface 130 spans a sufficient area, a user naturally and comfortably may grasp and step on a plurality of deployed climbing aids 100 without having to perfectly turn and place each foot and hand to make secured contact. A user will face no risk of having a hand or foot wedge against the columnar structure and create an imbalance. Regardless of how rotationally aligned each deployed climbing aid 100 is with the other deployed climbing aids 100, a user may climb comfortably, safely and efficiently.

It is noted that the foregoing examples have been provided merely for the purpose of explanation and are in no way to be construed as limiting of the present invention. While the present invention has been described with reference to an exemplary embodiment, it is understood that the words, which have been used herein, are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

I claim:

1. A portable climbing aid for use in climbing a columnar structure, the climbing aid comprising:

a) a unitary, tubular body comprising:

i) a planar or concave contact surface that, in use, directly contacts the columnar structure, the contact surface having a substantially vertical axis when in use, wherein the contact surface has an elliptical outer perimeter when planar;

ii) a support surface for supporting a foot or hand when in use, the support surface having no direct contact with the columnar structure and having a substantially perpendicular orientation relative to the substantially vertical axis of the contact surface when in use, wherein the support surface has an elliptical outer perimeter;

iii) a projecting portion joining between the contact surface and the support surface so that, in use, the projecting portion is capable of not contacting the columnar structure, wherein the projecting portion of the unitary, tubular body is cantilevered in use such that a central axis of the projecting portion is at an angle at or between 35 and 55 degrees from the vertical axis of the contact surface, and wherein the projecting portion comprises retaining elements formed therein; and b) a tension member adapted for affixing the unitary, tubular body to the columnar structure, wherein the retaining elements formed in the projecting portion receive the tension member therethrough; and c) a malleable material disposed on the contact surface for conforming to surface contours on the columnar structure.

2. The portable climbing aid of claim 1 further comprising a particulate layer adhered to the contact surface.

3. The portable climbing aid of claim 1 wherein the unitary, tubular body has a sidewall thickness of at least 200 mils.

4. The portable climbing aid of claim 1 wherein the unitary, tubular body is manufactured from a material selected from a group consisting of PVC tubing, extruded steel, tempered steel, chromoly, fiberglass, and cast aluminum.

5. The portable climbing aid of claim 1 wherein the retaining elements are located near a center of gravity of the unitary, tubular body.

6. The portable climbing aid of claim 1 wherein the retaining elements are a pair of holes disposed opposite one another around the unitary, tubular body and wherein the holes are substantially perpendicular to the columnar structure.

7. The portable climbing aid of claim 1 wherein the retaining elements are a pair of slots disposed opposite one another around the unitary, tubular body, and wherein the slots are substantially parallel to the contact surface.

8. The portable climbing aid of claim 1 wherein the tension member is a strap.

9. The portable climbing aid of claim 8 wherein the strap is a ratchet strap.

10. The portable climbing aid of claim 1 wherein the support surface is sized and shaped for ergonomic use with a hand and a foot.

* * * * *